US009050601B2

(12) United States Patent
Ha

(10) Patent No.: US 9,050,601 B2
(45) Date of Patent: Jun. 9, 2015

(54) CONE-SHAPED CRUSHER

(75) Inventor: Yong-Gan Ha, Chungbuk (KR)

(73) Assignee: Yong-Gan Ha, Goesan-gun, Chungcheongbuk-do ( * ) Notice: Subject to any disclaimer, the term of this patent is extended or adjusted under 35 U.S.C. 154(b) by 92 days.

(21) Appl. No.: 14/009,112

(22) PCT Filed: Apr. 16, 2012

(86) PCT No.: PCT/KR2012/002879

§ 371 (c)(1),
(2), (4) Date: Oct. 1, 2013

(87) PCT Pub. No.: WO2012/141558

PCT Pub. Date: Oct. 18, 2012

(65) Prior Publication Data

US 2014/0027550 A1 Jan. 30, 2014

(30) Foreign Application Priority Data

Apr. 14, 2011 (KR) ..... 10-2011-0034523
Mar. 13, 2012 (KR) ..... 10-2012-0025599

(51) Int. Cl.

| | |
|---|---|
| ***B02C 2/04*** | (2006.01) |
| ***B02C 2/06*** | (2006.01) |
| ***B02C 2/02*** | (2006.01) |
| *B02C 2/00* | (2006.01) |

(52) U.S. Cl.

CPC ... *B02C 2/06* (2013.01); *B02C 2/02* (2013.01); *B02C 2/00* (2013.01); *B02C 2/04* (2013.01)

(58) Field of Classification Search

CPC ..... B02C 2/00; B02C 2/02; B02C 2/04; B02C 2/06; B02C 2/042
USPC ..... 241/207–215
See application file for complete search history.

(56) References Cited

U.S. PATENT DOCUMENTS

| | | | | | |
|---|---|---|---|---|---|
| 1,641,776 | A | * | 9/1927 | Newhouse | 241/209 |
| 1,936,728 | A | * | 11/1933 | McCaskell | 241/209 |
| 2,192,483 | A | * | 3/1940 | Augustine et al. | 384/255 |

FOREIGN PATENT DOCUMENTS

| | | | |
|---|---|---|---|
| EP | 1839754 | A2 | 10/2007 |
| JP | 2001-162186 | A | 6/2001 |
| JP | 3652664 | B2 | 5/2005 |
| KR | 10-2007-0020242 | A | 2/2007 |
| KR | 10-0809900 | B1 | 3/2008 |
| WO | 2009-065995 | A1 | 5/2009 |

OTHER PUBLICATIONS

International Search Report in International Application No. PCT/KR2012/002879, dated Sep. 5, 2012.

* cited by examiner

*Primary Examiner* — Faye Francis
(74) *Attorney, Agent, or Firm* — Lowe Hauptman & Ham, LLP

(57) ABSTRACT

A cone-shaped crusher according to the invention includes a frame having a cavity; a main shaft that is disposed in the cavity; main shaft driving means for driving the main shaft such that the main shaft performs a gyratory movement; a mantle core assembly body that performs a gyratory movement together with the main shaft; a suspension bearing chamber capable of accommodating an upper end portion of the main shaft; and a suspension bearing. According to the cone-shaped crusher, there are advantages in that damage to the suspension bearing can be minimized, the gyratory movement of the main shaft can be stably performed, and a suspension bearing part can be used semi-permanently without requiring replacement.

16 Claims, 5 Drawing Sheets

CONE-SHAPED CRUSHER

CROSS-REFERENCE TO RELATED APPLICATIONS

This application is the National Stage filing under 35 U.S.C. 371 of International Application No. PCT/KR2012/002879, filed on Apr. 16, 2012, which claims the benefit of Korean Patent Application No. 10-2011-0034523, filed on Apr. 14, 2011, and Korean Patent Application No. 10-2012-0025599, filed on Mar. 13, 2012, the contents of which are all hereby incorporated by reference herein in their entirety.

TECHNICAL FIELD

The present invention relates to a cone-shaped crusher, and more particularly, to a cone-shaped crusher where the upper end portion of the main shaft that performs a gyratory movement is supported by a bearing.

BACKGROUND ART

This application claims the benefit of Korean Patent Application No. 10-2011-0034523 filed on Apr. 14, 2011 and Korean Patent Application No. 10-2012-0025599 filed on Mar. 13, 2012. All of the contents disclosed in the description and drawings of this application are incorporated herein by reference.

Cone-shaped crushers are very important as crushers in aggregate and mineral processing industries. Various structures and types have been developed for a variety of uses.

International Patent Publication No. WO2009/065995 discloses a general structure of a cone-shaped crusher, and the cone-shaped crusher includes a frame having a cavity formed therein, a first crushing blade that is provided inside the frame, a main shaft that is eccentrically accommodated in the frame, a truncated cone-shaped crushing head that is coupled to an outer circumferential surface of the main shaft, a second crushing blade that covers the surface of the crushing head, an upper bearing part that is coupled to an upper end portion of the main shaft, a lower bearing part that is coupled to a lower end portion of the main shaft, and driving means that drives the main shaft so that the main shaft can perform a gyratory movement. Here, the first crushing blade is spaced apart at a proper distance from the second crushing blade mounted on an outer circumferential surface of the crushing head. Objects to be crushed that are put into the cone-shaped crusher are compressed and crushed when the gap between the first crushing blade and the second crushing blade that performs a gyratory movement along the main shaft becomes gradually narrow, and the crushed aggregate is discharged to the outside by repeating the falling process when the gap between the first crushing blade and the second crushing blade increases.

The above-described cone-shaped crusher adopts a spherical bearing as the upper bearing part. The spherical bearing includes a stationary part that is fixed to the frame and has an inner frictional surface formed spherically, and a movable part that is coupled to the upper end of the main shaft rotates while supported by the stationary part and has an outer frictional surface formed spherically.

However, as the above-described cone-shaped crusher is operated, the spherical bearing is worn out, and thus, a gap is generated between the stationary part and the movable part, and the upper end portion of the main shaft is not accurately supported in its originally designed state. Also, since the upper end portion of the main shaft is operated while being jolted by the gap, the wear of the spherical bearing is gradually accelerated. This phenomenon changes the eccentric angle of the main shaft, and if the main shaft performs a gyratory movement with the changed eccentric angle, the wear of the lower bearing coupled to the lower end portion of the main shaft may be accelerated, thereby causing the breakdown of the lower bearing.

Even if there is no problem in the lubricating system of the above-described cone-shaped crusher, if a person operating the cone-shaped crusher does not replace the upper bearing and the lower bearing at an accurate replacement time and uses the bearings slightly longer, then the cone-shaped crusher is greatly damaged, thereby causing huge repair costs.

DETAILED DESCRIPTION OF THE INVENTION

Technical Objectives

The invention has been made in order to solve the above problems, and to provide a cone-shaped crusher that includes an upper bearing part having a long lifespan that reduces maintenance expenses.

Another objective of the invention is to provide a cone-shaped crusher with a rotatable ring that can be stably supported by a stationary ring even if the upper bearing part is slightly worn out.

In addition, another objective of the invention is to provide a cone-shaped crusher with an upper bearing part that has strong wear resistance and is not easily deformed.

Moreover, still another objective of the invention is to provide a cone-shaped crusher that can be used semi-permanently without replacing the upper bearing part because the cone-shaped crusher can be restored to its normal state with simple maintenance when the upper bearing part is worn out.

Means for Solving the Problems

In order to achieve the above objectives, a cone-shaped crusher according to the preferred embodiment of the invention includes a frame having a cavity, a main shaft disposed in the cavity eccentrically from a central axis of the frame, main shaft driving means for driving the main shaft such that the main shaft performs a gyratory movement, a mantle core assembly coupled to the main shaft so as to perform a gyratory movement together with the main shaft, a suspension bearing chamber capable of accommodating an upper end portion of the main shaft, a suspension bearing including a stationary ring and a rotatable ring, a stationary ring being provided on an inner circumferential surface of the suspension bearing chamber, and the rotatable ring being coupled to the upper end portion of the main shaft and being surrounded by an inner circumferential surface of the stationary ring. An outer circumferential surface of the rotatable ring is formed in the shape of a rotary body with a rotation radius that gradually decreases downward from above. The inner circumferential surface of the stationary ring is formed such that the inner diameter gradually decreases downward from above so as to correspond to the shape of the outer circumferential surface of the rotatable ring. An angle $\theta_2$ between two cross sectional lines of inner circumferential surfaces of the stationary ring taken along a central axis of the stationary ring is greater than an angle $\theta_1$ between two cross sectional lines of outer circumferential surfaces of the rotatable ring taken along a central axis of the rotatable ring. The difference angle $\theta_3$ between $\theta_1$ and $\theta_2$ is greater than the eccentric angle $\alpha$ of the main shaft. The outer circumferential surface of the rotatable ring is brought into contact with and pressed against the inner circumferential surface of the stationary ring due to the self-weight of the main shaft and the mantle core assembly.

Preferably, the difference angle $\theta_3$ between the two angles is two times greater than the eccentric angle $\alpha$ of the main shaft.

Preferably, the outer circumferential surface of the rotatable ring and the inner circumferential surface of the stationary ring are formed such that the reduction rate of the rotation radius is uniform or gradually increased or reduced downward from above.

Preferably, the cone-shaped crusher further includes a fixing member fixing the rotatable ring to the main shaft Preferably, an inner circumferential surface of the rotatable ring is formed in a shape that becomes gradually narrower downward from above, the fixing member includes a detachable sleeve coupled to the main shaft, an outer circumferential surface of the detachable sleeve becoming gradually narrower downward from above so as to correspond to the inner circumferential surface of the rotatable ring; and a fixing nut coupled to an upper end portion of the main shaft exposed above the disengageable sleeve such that the disengageable sleeve is pressed downward and the outer circumferential surface of the disengageable sleeve comes into contact with the inner circumferential surface of the rotatable ring.

Preferably, a suspension bearing seal member surrounding an upper outer circumferential surface of the main shaft is provided at the lower end portion of the suspension bearing chamber so as to prevent dust from flowing into the space between the suspension bearing chamber and the main shaft. The center of the gyratory movement of the main shaft is located on a central axis of the main shaft, and an inner-diameter portion of the suspension bearing seal member is provided in the vicinity of the center of the gyratory movement of the main shaft such that the amount of deformation of the suspension bearing seal member due to the gyratory movement of the main shaft is minimized.

Preferably, the suspension bearing further comprises a lower support protrusion capable of supporting a lower end portion of the rotatable ring, the lower support protrusion annularly extending from a lower end portion of the stationary ring toward an outer circumferential surface of the main shaft. The gap formed between a lower surface of the rotatable ring, the upper surface of the lower support protrusion at a point opposite to a contact line between the rotatable ring and the stationary ring gradually increases away from the center of the main shaft. The angle $\theta_4$ between the lower surface of the rotatable ring and the upper surface of the lower support protrusion at the point opposite to the contact line is two times greater than the eccentric angle $\alpha$ of the main shaft. The main shaft is capable of performing a gyratory movement in a state where the outer circumferential surface of the rotatable ring comes into contact with the inner circumferential surface of the stationary ring or the lower surface of the rotatable ring comes into contact with the upper surface of the lower support protrusion.

Preferably, the inner circumferential surface of the stationary ring and the upper surface of the lower support protrusion is formed so as to be harder than the outer circumferential surface and lower surface of the rotatable ring or the outer circumferential surface and lower surface of the rotatable ring is formed so as to be harder than the inner circumferential surface of the stationary ring and the upper surface of the lower support protrusion.

Preferably, the lower surface of the rotatable ring and the upper surface of the lower support protrusion are inclined such that the central portions of the upper and lower surfaces are located higher than the peripheries.

Preferably, the suspension bearing further comprises an upper support protrusion capable of being supported by an upper end portion of the stationary ring, the upper support protrusion annularly extending from an upper end portion of the rotatable ring toward an inner circumferential surface of the suspension bearing chamber, a gap formed between an upper surface of the stationary ring and a lower surface of the upper support protrusion at a point opposite to a contact line between the rotatable ring and the stationary ring gradually increases away from the center of the main shaft. The angle $\theta_5$ between the upper surface of the stationary ring and the lower surface of the upper support protrusion at the point opposite to the contact point is two times greater than the eccentric angle $\alpha$ of the main shaft, and the main shaft is capable of performing a gyratory movement in a state where the outer circumferential surface of the rotatable ring comes into contact with the inner circumferential surface of the stationary ring or the lower surface of the upper support protrusion comes into contact with the upper surface of the stationary ring.

Preferably, the inner circumferential surface and upper surface of the stationary ring are formed so as to be harder than the outer circumferential surface of the rotatable ring and the lower surface of the upper support protrusion or the outer circumferential surface of the rotatable ring and the lower surface of the upper support protrusion are formed so as to be harder than the inner circumferential surface and upper surface of the stationary ring.

Preferably, the upper surface of the stationary ring and the lower surface of the upper support protrusion are inclined such that the central portions of the upper and lower surfaces are located higher than the peripheries.

Preferably, a stepped part is provided at the upper end portion of the main shaft in order to limit the depth of a portion of the rotatable ring that is fitted downward in the longitudinal direction of the main shaft, and the height of the main shaft relative to the suspension bearing chamber is capable of being adjusted by changing the number or height of rotatable ring gap members provided between the lower end portion of the rotatable ring and the stepped part.

Preferably, the stationary ring includes a first annular stepped part provided at the lower portion of its outer circumference, the suspension bearing chamber includes a second annular stepped part provided on the inner surface so as to correspond to the first stepped part of the stationary ring, and the height of the main shaft relative to the suspension bearing chamber is capable of being adjusted by changing the number of stationary-ring-side gap members provided between the first and second stepped parts.

Advantageous Effect of the Invention

The cone-shaped crusher according to the invention has the following advantages.

Firstly, it is possible to provide a cone-shaped crusher that includes an upper bearing part having a long life and that can reduce maintenance expenses.

Secondly, it is possible to provide a cone-shaped crusher that includes the rotatable ring that can be stably supported by the stationary ring even if the upper bearing part is slightly worn out.

Thirdly, it is possible to provide a cone-shaped crusher that includes the upper bearing part that has strong wear resistance and is not easily deformed.

Fourthly, it is possible to provide a cone-shaped crusher that can be used semi-permanently without replacing the upper bearing part because the cone-shaped crusher can be restored to its normal state with simple maintenance when the upper bearing part is worn out.

BRIEF DESCRIPTION OF DRAWINGS

The following drawings appended to the present description illustrate preferable embodiments of the invention, and serve to make the technical ideas of the invention more clearly understood together with the detailed description of the invention. Thus, the invention should not be limited and interpreted as the contents set forth in the drawings.

FIG. 4 is a partially enlarged view illustrating a cone-shaped crusher according to a third preferred embodiment of the invention, and illustrating the upper end portion of the main shaft and the suspension bearing chamber; and.

BEST MODES FOR CARRYING OUT THE INVENTION

Figure 1:
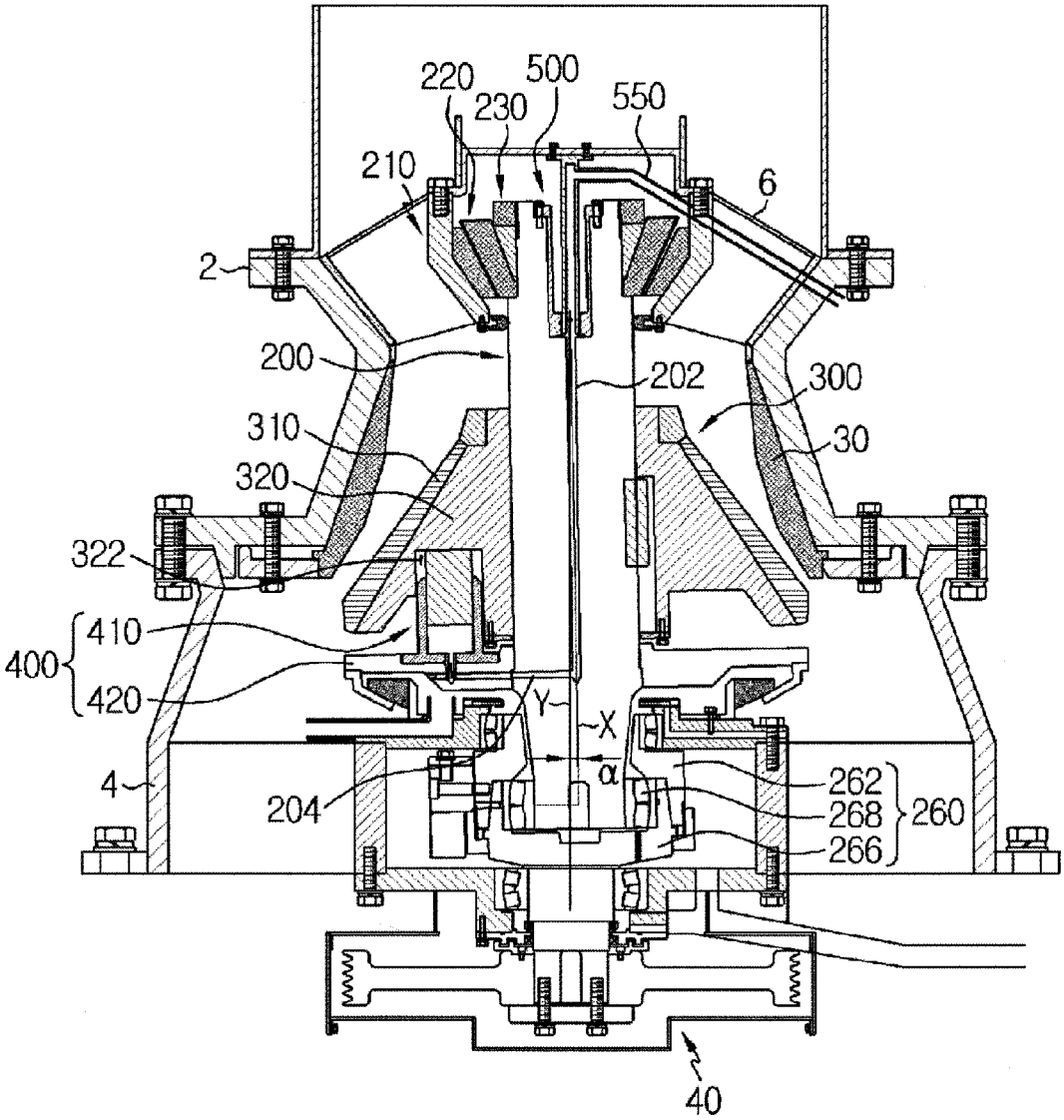
FIG. 1 is a sectional view illustrating a cone-shaped crusher according to a preferred first embodiment of the invention.

Hereinafter, cone-shaped crushers according to the preferred embodiments of the invention will be described in detail with reference to the accompanying drawings.

A cone crusher, a gyratory crusher, and the like are commonly referred to as a cone-shaped crusher in the following description.

The terms and words used in the description and claims of the application should not be limited or interpreted as common or dictionary meanings, but should be interpreted as meanings and notions that conform with the technical ideas of the invention, on the basis of the principal in which the notions of the terms can be appropriately defined in order for the inventor to describe his invention in the best way. Thus, since the embodiments described in the present description and the configurations illustrated in the drawings are merely most preferable embodiments of the invention, and do not represent all the technical ideas of the invention, it should be understood that the invention covers various equivalents and modifications that can replace these embodiments configurations when the present application is filed.

For convenience of description and for clear description, in the drawings, the sizes of respective constituent elements or specific parts constituting the constituent elements are exaggerated, are omitted, or are schematically illustrated. Therefore, the sizes of the respective constituent elements do not reflect actual sizes completely. If it is thought that specific descriptions regarding the relevant publicly-known functions or configurations make the key point of the invention unnecessarily ambiguous, such descriptions will be omitted.

Figure 2:
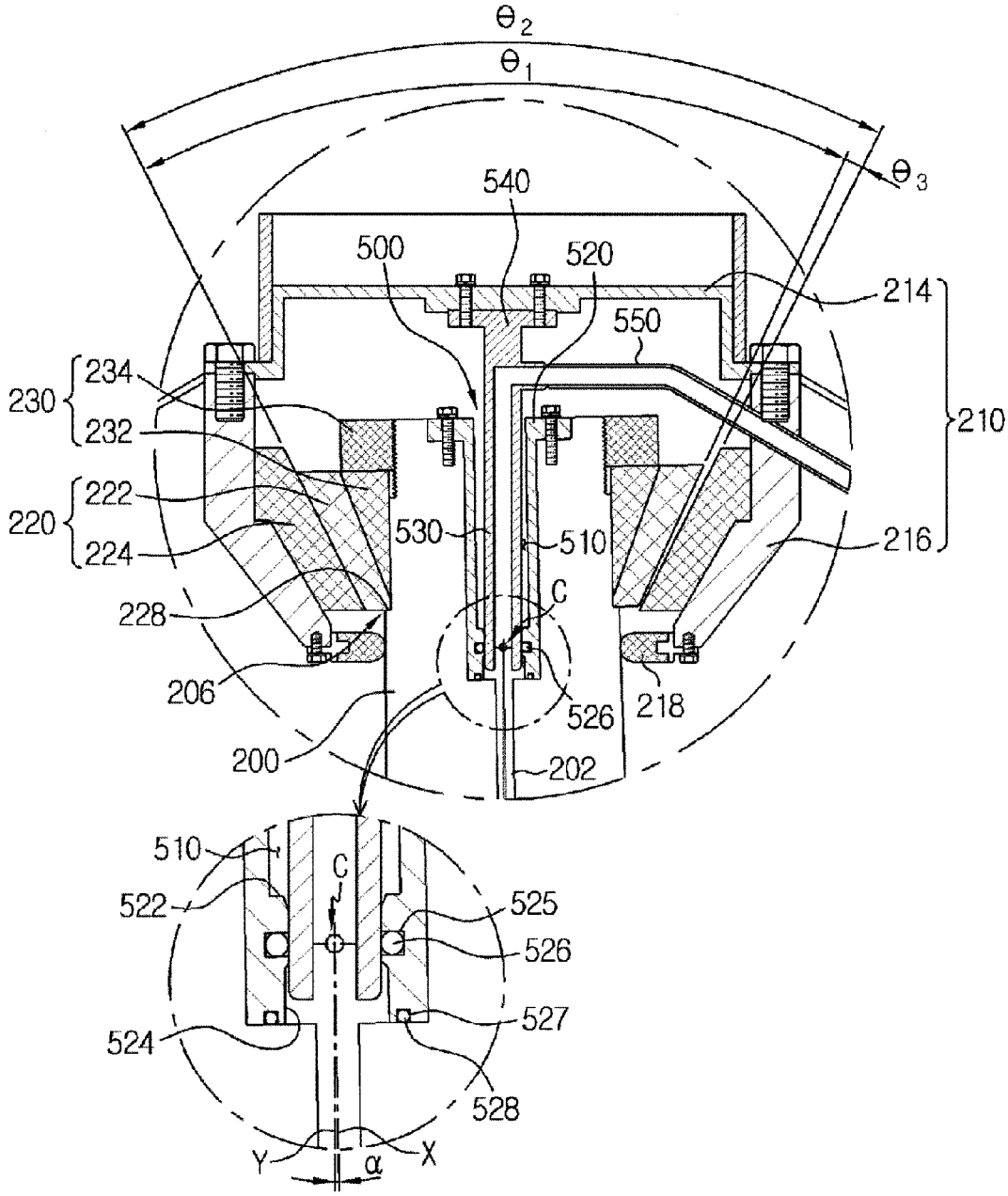
FIG. 2 is a partially enlarged view illustrating the first embodiment shown in FIG. 1, and illustrating an upper end portion of a main shaft and a suspension bearing chamber.

FIG. 1 is a sectional view illustrating a cone-shaped crusher according to a preferred first embodiment of the invention. FIG. 2 is a partially enlarged view illustrating the first embodiment shown in FIG. 1, and illustrates an upper end portion of a main shaft and a suspension bearing chamber.

The cone-shaped crusher according to the first embodiment of the invention will be described below with reference to FIGS. 1 and 2.

The cone crusher according to the first embodiment includes a main frame 4 having a cavity formed therein, an upper frame 2 seated on an upper portion of the main frame 4 with a cavity formed therein, and consisting of at least one or more layers: a concave 30 formed in a truncated funnel shape having an inner diameter that gradually increases downward from above and is mounted on a lower inner circumferential surface of the upper frame 2, a main shaft 200 disposed in the cavities of the frames 2 and 4 eccentrically from a central axis Y of the frames 2 and 4 to perform a gyratory movement; a mantle core assembly 300 coupled to the main shaft 200 so as to be movable along the longitudinal direction of the main shaft 200 and performing a gyratory movement together with the main shaft 200, a suspension bearing chamber 210 disposed at the upper center of the upper frame 2 and having an opening formed at a lower portion thereof so as to be capable of accommodating an upper end portion of the main shaft 200; a suspension bearing 220 having a stationary ring 224 provided on an inner circumferential surface of the suspension bearing chamber 210 and a rotatable ring 222 coupled to the upper end portion of the main shaft 200 and surrounded by an inner circumferential surface of the stationary ring 224; an eccentric drive 260 coupled to a lower end portion of the main shaft 200, and making the main shaft 200 eccentric from the central axis Y of the frames 2 and 4 by a predetermined angle; main shaft driving means 40 rotating the eccentric drive 260 to drive the main shaft 200 such that the main shaft performs a gyratory movement; a crushing gap adjustment part 400 provided below the mantle core assembly 300 so as to be capable of adjusting a crushing gap; and a rotary joint 500 supplying hydraulic oil to hydraulic oil passages 202 and 204 formed inside the main shaft 200.

A method of operating the cone-shaped crusher according to the first embodiment of the invention will be briefly described below. Objects to be crushed are supplied through the upper frame 2, the main shaft 200 and the mantle core assembly 300 fitted on the main shaft 200 perform a gyratory movement. The objects to be crushed are crushed between the concave 30 and the mantle core assembly 300 and fall to a lower portion of the main frame 4. Also, this operation method is applied in common to all embodiments of the invention as well as the first embodiment.

The contents of the above configurations of the first embodiment, which overlap with the contents of a general cone-shaped crusher, will be omitted, and distinguished configurations will mainly be described below so that the key technical ideas of the invention can be more clearly understood.

The lower end portion of the main shaft 200 is accommodated inside the main frame 4, and the upper end portion of the main shaft 200 is accommodated in the upper frame 2 through the concave 30. Moreover, a vertical hydraulic oil passage 202 is formed inside the main shaft 200 along the longitudinal direction of the main shaft 200, and a horizontal hydraulic oil passage 204, which is horizontally disposed at a lower end of the vertical hydraulic oil passage 202, is formed inside the main shaft 200. The hydraulic oil passages 202 and 204 communicate with an oil passage formed in the crushing gap adjustment part 400 to be described below.

The mantle core assembly 300 includes a mantle core 320 formed in a truncated cone shape as a whole with a cylindrical opening formed at its central portion, and a mantle 310 mounted to surround the surface of the mantle core 320 is formed in a hollow truncated cone shape. Hydraulic jack accommodating portions 322 accommodating hydraulic jacks 410 to be described below are formed in a lower surface of the mantle core 320, and at least two or more hydraulic jack accommodating portions 322 are preferably formed.

In order to prevent the main shaft 200 and the mantle core assembly 300 from rotating relative to each other, an anti-rotation mechanism may be provided between the main shaft 200 and the mantle core 320. A key and a key groove may be used as such an anti-rotation mechanism. In addition, spline processing may be performed on an inner surface of a cylindrical opening formed at the center of the mantle core 320 and on an outer circumferential surface of the main shaft 200.

The suspension bearing chamber 210 which is connected to the upper frame 2 by a supporting arm 6, is located at the upper center of the upper frame 20, and includes a suspension bearing chamber outer case 216 and a suspension bearing chamber lid 214 detachably provided at an upper portion of the suspension bearing chamber outer case 216. The upper portion of the suspension bearing chamber outer case 216 is formed in a cylindrical shape, and the lower portion of the suspension bearing chamber outer case 216 is formed in a truncated funnel shape.

The suspension bearing 220 includes the stationary ring 224 provided in the inner circumferential surface of the suspension bearing chamber 210, and the rotatable ring 222 coupled to the upper end portion of the main shaft 200 and surrounded by the inner circumferential surface of the stationary ring 224.

The eccentric drive 260 includes an upper eccentric shaft 262 having an opening formed at its center portion, a lower eccentric shaft 266 coupled to the lower portion of the upper eccentric shaft 262, and an eccentric bearing 268 seated in the space surrounded by the upper eccentric shaft 262 and the lower eccentric shaft 266. The lower end portion of the main shaft 200 is inserted into the eccentric bearing 268, and the eccentric bearing 268 is provided eccentrically from the rotation axis of the eccentric drive 260 itself. Therefore, if the eccentric drive 260 rotates around its rotation axis, the lower end portion of the main shaft 200 revolves around the rotation axis of the eccentric drive 260. Since the upper end portion of the main shaft 200 is accommodated in the suspension bearing chamber 210 and revolves with a small rotation radius, and the lower end portion of the main shaft 200 revolves with a relatively large rotation radius, the main shaft 200 performs a gyratory movement around its upper end portion.

The main shaft driving means 40 transmits a driving force to the eccentric drive 260 so that the eccentric drive 260 can rotate. A driving source, such as a motor, v-belts, and pulleys may be used as the main shaft driving means 40, and the v-belts and the pulleys may be replaced with a plurality of gears. In addition, various structures that transmit driving force may be adopted.

The crushing gap adjustment part 400 includes a crushing gap adjustment supporting plate 420 fitted on the main shaft 200 and having formed therein an oil passage communicating with the hydraulic oil passages 202 and 204 formed in the main shaft 200 without oil leak, and the hydraulic jacks 410 disposed on the crushing gap adjustment supporting plate 420 to support the mantle core assembly 300 from below and arranged outside the main shaft 200. A hydraulic pressure jack 410 includes a cylinder and a ram fitted into the cylinder. In the crushing gap adjustment part 400, the ram is able to elevate with the pressure of the hydraulic oil supplied into the cylinder via the hydraulic oil passages 202 and 204. The mantle core assembly 300 is movable along the longitudinal direction of the main shaft 200 with the elevation of the ram.

The rotary joint 500 is located in the suspension bearing chamber 210 accommodating the upper end portion of the main shaft 200, and includes a recessed part 510 formed so as to be recessed in a pillar shape from the upper end portion of the main shaft 200 toward the lower end, a pipe-shaped rotary joint housing 520 fitted into the recessed part 510, an outer hydraulic oil inlet pipe 550 used as a passage for the hydraulic oil supplied from the outside, a conduit fixing part 540 communicating with the outer hydraulic oil inlet pipe 550 and fixed to the suspension bearing chamber lid 214, and a hydraulic oil conduit 530 extending downward from the conduit fixing part 540 and supplying the hydraulic oil to the vertical hydraulic oil passage 202 of the main shaft 200.

Hereinafter, the structure of the suspension bearing 200, the rotary joint 500, and the reason that the main shaft 200 can stably perform a gyratory movement even if the suspension bearing 220 is slightly worn out will be sequentially described.

First, the suspension bearing 200 will be described.

The rotatable ring 222 is formed in the shape of a rotary body as a whole, an outer circumferential surface of the rotatable ring 222 is formed in a truncated cone shape having a rotation radius that becomes gradually smaller downward from above, and an opening coupled to the upper end portion of the main shaft 200 is formed at a central portion of the rotatable ring 222. The outer circumferential surface of the rotatable ring 222 may be formed as shown in FIGS. 1 and 2 such that the reduction amount of the rotation radius is uniform downward from above. On the other hand, the outer circumferential surface of the rotatable ring 222 may be formed such that the reduction amount of the rotation radius becomes gradually larger or smaller.

The inner circumferential surface of the stationary ring 224 is formed so as to have an inner diameter that becomes gradually smaller downward from above such that the shape of the inner circumferential surface of the stationary ring 224 corresponds to the shape of the outer circumferential surface of the rotatable ring 222. However, the diameter of the inner circumferential surface of the stationary ring 224 should be greater than the diameter of the outer circumferential surface of the rotatable ring 222 so that the main shaft 200 can perform a gyratory movement.

Referring to FIG. 2, the angle $\theta_2$ formed by two cross sectional lines of inner circumferential surfaces of the stationary ring 224 taken along a central axis of the stationary ring 224 is greater than the angle $\theta_1$ formed by two cross sectional lines of outer circumferential surfaces of the rotatable ring 222 taken along a central axis of the rotatable ring 222. Also, the difference angle $\theta_3$ between the two angles is the angle of $\theta_2$-$\theta_1$, and the difference angle is greater than the eccentric angle $\alpha$ of the main shaft 200. Here, the eccentric angle $\alpha$ is the angle between a central axis X of the main shaft 200 and the central axis Y of the frames 2 and 4, and the difference angle $\theta_3$ is two times greater than the eccentric angle $\alpha$ of the main shaft 200.

The outer circumferential surface of the rotatable ring 222 is brought into contact with and pressed against the inner circumferential surface of the stationary ring 224 due to the weight of the main shaft 200 and the mantle core assembly 300. From a geometric viewpoint, the rotatable ring 222 always comes into linear contact with the inner circumferential surface of the stationary ring 224. Moreover, even if the outer circumferential surface of the rotatable ring 222 and the inner circumferential surface of the stationary ring 224 is slightly worn out by friction, the outer circumferential surface of the rotatable ring 222 is still brought into contact with and pressed against the inner circumferential surface of the stationary ring 224 due to the weight of the main shaft 200 and the mantle core assembly 300.

If the reduction amount of the rotation radius of the outer circumferential surface of the rotatable ring 222 becomes gradually larger or smaller downward from above unlike FIGS. 1 and 2, a difference angle between a tangent line at a specific position on the outer circumferential surface of the rotatable ring 222 and a tangent line at a specific position on the inner circumferential surface of the stationary ring 224 is the angle of $\theta_2$-$\theta_1$. Here, the specific position on the inner circumferential surface of the stationary ring 224 corresponds to the specific position on the outer circumferential surface of the rotatable ring 222.

A fixing member couples the rotatable ring 222 to the main shaft 200, and the fixing member includes a detachable sleeve 232 and a fixing nut 234. The detachable sleeve 232 is fitted on the outer circumferential surface of the main shaft 200, and has an outer circumferential surface that becomes gradually narrower downward from above so as to correspond to the shape of the inner circumferential surface of the rotatable ring 222. Here, the inner circumferential surface of the rotatable ring 222 becomes gradually narrower downward from above.

Also, the fixing nut 234 is coupled to the upper end of the main shaft 200 exposed above the detachable sleeve 232, and presses the detachable sleeve 232 downward to bring the outer circumferential surface of the detachable sleeve 232 into close contact with the inner circumferential surface of the rotatable ring 222.

Hereinafter, the rotary joint 500 will be described.

In the rotary joint housing 520, a coupling flange is formed at its upper end portion and a seal groove 527 for preventing leaking of hydraulic oil is formed on the surface of the lower end, a seal 528 is fitted into the seal groove. A cylindrical space having a large diameter is formed in the upper portion of the rotary joint housing 520, a cylindrical space having a small diameter is formed in the lower portion of the rotary joint housing 520, and a stair part 522 is formed at a position where the two cylindrical spaces meet each other. Moreover, a seal groove 525 for preventing leaking of hydraulic oil is formed in an inner surface 524 of the small-diameter cylindrical space, and a seal 526 is fitted into the seal groove 525. Also, the coupling flange of the rotary joint housing 520 is fixed to the upper end of the main shaft 200 with bolts.

A suspension bearing chamber seal 218 is formed in an annular shape and is formed of an elastic material. It has an inner-diameter portion that surrounds the outer circumferential surface of the main shaft 200 and an outer-diameter portion that is coupled to a lower end portion of the suspension bearing chamber 210 so that dust can be prevented from flowing into a space between a lower opening of the suspension bearing chamber 210 and the outer circumferential surface of the main shaft 200. The place where the main shaft 200 has the least movement when the main shaft 200 performs a gyratory movement is the vicinity of the center of the gyratory movement. Therefore, the suspension bearing chamber seal 218 is preferably disposed such that the inner-diameter portion of the suspension bearing chamber seal 218 is located in the vicinity of the center of the gyratory movement of the main shaft 200 so that the amount of deformation of the suspension bearing chamber seal 218 caused by the gyratory movement of the main shaft 200 can be minimized.

Figure 3:
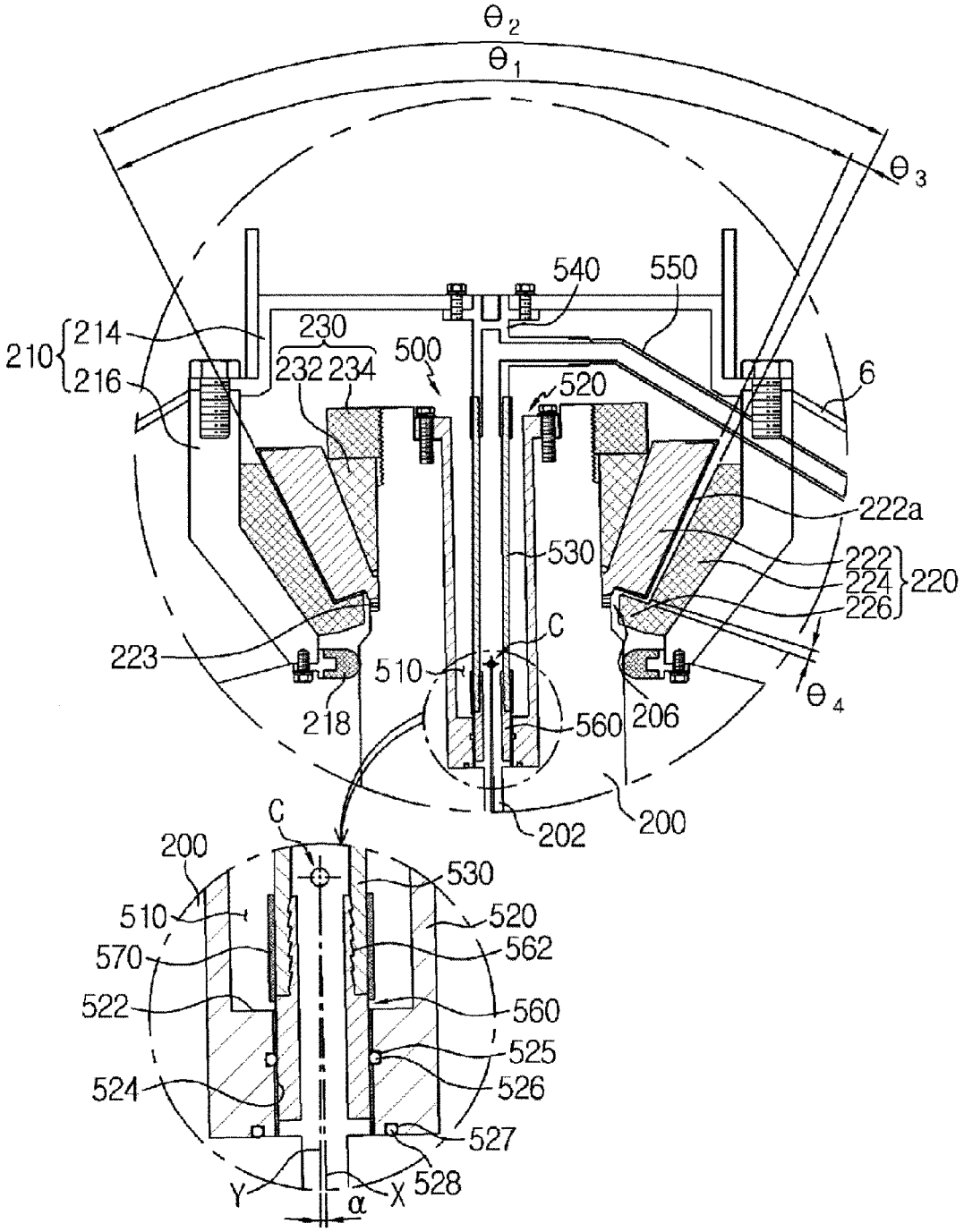
FIG. 3 is a partially enlarged view illustrating a cone-shaped crusher according to a second preferred embodiment of the invention, and illustrating the upper end portion of the main shaft and the suspension bearing chamber.

FIG. 3 is a partially enlarged view illustrating a cone-shaped crusher according to a second embodiment of the invention, and illustrating the upper end portion of the main shaft and the suspension bearing chamber.

Referring to FIG. 3, the greatest difference between the first embodiment and the second embodiment is the suspension bearing 220. The suspension bearing 220 according to the second embodiment includes a lower support protrusion 226. Also, the configuration of the rotary joint 500 according to the second embodiment is different from the configuration of the rotary joint 500 according to the first embodiment.

In the second embodiment, the suspension bearing 220 includes the stationary ring 224 provided in the inner circumferential surface of the suspension bearing chamber 210, the rotatable ring 222 coupled to the upper end portion of the main shaft 200 and surrounded by the inner circumferential surface of the stationary ring 224, and the lower support protrusion 226 extending annularly from the lower end portion of the stationary ring 224 toward the outer circumferential surface of the main shaft 200 so as to be capable of supporting the lower end portion of the rotatable ring 222.

The rotatable ring 222 is formed in the shape of a rotary body as a whole, the outer circumferential surface of the rotatable ring 222 is formed in a truncated cone shape having a rotation radius that becomes gradually smaller downward from above, and the opening coupled to the upper end portion of the main shaft 200 is formed at the central portion of the rotatable ring 222. The outer circumferential surface of the rotatable ring 222 may be formed as shown in FIG. 3 such that the reduction amount of the rotation radius is uniform downward from above. On the other hand, the outer circumferential surface of the rotatable ring 222 may be formed such that the reduction amount of the rotation radius becomes gradually larger or smaller.

The inner diameter of the inner circumferential surface of the stationary ring 224 becomes gradually smaller downward from above such that the shape of the inner circumferential surface of the stationary ring 224 corresponds to the shape of the outer circumferential surface of the rotatable ring 222. However, the diameter of the inner circumferential surface of the stationary ring 224 should be greater than the diameter of the outer circumferential surface of the rotatable ring 222 so that the main shaft 200 can perform a gyratory movement.

The lower support protrusion 226 extends annularly from the lower end portion of the stationary ring 224 toward the outer circumferential surface of the main shaft 200 to support the lower end portion of the rotatable ring 222. Also, a gap is preferably present between an inner circumferential surface of the lower support protrusion 226 and the outer circumferential surface of the main shaft 200 so as to prevent wear from occurring between the outer circumferential surface of the main shaft 200 and the inner circumferential surface of the lower support protrusion 226 while the main shaft 200 performs a gyratory movement.

If the main shaft 200 performs a gyratory movement, the outer circumferential surface and lower surface of the rotatable ring 222 comes into contact with the inner circumferential surface of the stationary ring 224 and an upper surface of the lower support protrusion 226. Therefore, in order to prevent the stationary ring 224 and the lower support protrusion 226, and the rotatable ring 222 from tightly coming into close contact with each other and being worn out, the inner circumferential surface of the stationary ring 224 and the upper surface of the lower support protrusion 226 may be formed so as to be harder than the outer circumferential surface and lower surface of the rotatable ring 222, or the outer circumferential surface and lower surface of the rotatable ring 222 may be formed so as to be harder than the inner circumferential surface of the stationary ring 224 and the upper surface of the lower support protrusion 226. For example, the stationary ring 224 and the lower support protrusion 226 may be formed of a hard material subjected to heat treatment, the rotatable ring 222 may be formed of a steel material softer than the hard material, and a lubricious coating layer 222*a* may be formed on the surface of the steel material. On the contrary, the rotatable ring 222 may be formed of a hard material subjected to heat treatment, the stationary ring 224 and the lower support protrusion 226 may be formed of a steel material softer than the hard material, and a lubricious coating layer 222*a* may be formed on the surface of the steel material.

The lower surface of the rotatable ring 222 and the upper surface of the lower support protrusion 226 are inclined such that the central portions of the lower and upper surfaces are located higher than their peripheries.

Referring to FIG. 3, the angle $\theta_2$ formed by two cross sectional lines of inner circumferential surface of the stationary ring 224 taken along the central axis of the stationary ring 224 is greater than the angle $\theta_1$ formed by two cross sectional lines of outer circumferential surface of the rotatable ring 222 taken along the central axis of the rotatable ring 222. Also, the difference angle $\theta_3$ between the two angles is the angle of $\theta_2$-$\theta_1$, and the difference angle is greater than the eccentric angle $\alpha$ of the main shaft 200. In more detail, the difference angle $\theta_3$ is two times greater than the eccentric angle $\alpha$ of the main shaft 200. From a geometric viewpoint, it can be seen that the rotatable ring 222 always comes into linear contact with the inner circumferential surface of the stationary ring 224.

Also, a gap is formed between the lower surface of the rotatable ring 222 and the upper surface of the lower support protrusion 226 at the place referred to the right portion of FIG. 3 opposite to the line referred to the left portion of FIG. 3 where the rotatable ring 222 and the stationary ring 224 come into contact with each other. Here, the gap becomes gradually larger in a direction away from the center of the main shaft 200. The angle $\theta_4$ between the lower surface of the rotatable ring 222 and the upper surface of the lower support protrusion 226 at the point opposite to the contact point is two times greater than the eccentric angle $\alpha$ of the main shaft 200. Therefore, the main shaft 200 can smoothly perform a gyratory movement in a state where the outer circumferential surface of the rotatable ring 222 comes into contact with the inner circumferential surface of the stationary ring 224 or the lower surface of the rotatable ring 222 comes into contact with the upper surface of the lower support protrusion 226.

A fixing member 230 couples the rotatable ring 222 to the main shaft 200, and the fixing member includes the detachable sleeve 232 and the fixing nut 234. The detachable sleeve 232 is fitted on the outer circumferential surface of the main shaft 200, and has an outer circumferential surface that becomes gradually narrower downward from above so as to correspond to the shape of the inner circumferential surface of the rotatable ring 222. Also, the fixing nut 234 is fastened to the upper end of the main shaft 200 exposed above the detachable sleeve 232, and presses the detachable sleeve 232 downward to bring the outer circumferential surface of the detachable sleeve 232 into close contact with the inner circumferential surface of the rotatable ring 222.

Hereinafter, the rotary joint 500 according to the second embodiment will be described.

In the rotary joint housing 520, the coupling flange is formed at its upper end portion, the seal groove 527 for preventing leakage of hydraulic oil that is formed on the lower surface of the lower end of the rotary joint housing 520, the seal 528 is fitted into the seal groove, the cylindrical space having a large diameter is formed in the upper portion of the rotary joint housing 520, the cylindrical space having a small diameter is formed in the lower portion of the rotary joint housing 520, and the stair part 522 is formed at a position where the two spaces meet each other. The coupling flange of the rotary joint housing 520 is fixed to the upper end of the main shaft 200 with bolts.

The stair part 522 is formed at a position lower than the center C of the gyratory movement of the main shaft 200. The seal groove 525 for preventing leakage of hydraulic oil is formed on the inner surface 524 of the circumferential space having a small diameter, and the seal 526 is fitted into the seal groove 525. The inner surface 524 of the circumferential space is preferably coated with lead bronze, brass, or the like so as to reduce the wear.

A conduit fixing part 540 is formed at the center of the lower surface of the suspension bearing chamber lid 214 located at the upper portion of the suspension bearing chamber 210, the hydraulic oil conduit 530 is coupled to the lower end portion of the conduit fixing part 540, and the outer hydraulic oil inlet pipe 550 is coupled to a side surface of the conduit fixing part 540.

A cylindrical space is formed at the central portion of the rotary joint housing 520, and a flexible hydraulic oil conduit 530 is accommodated in the cylindrical space. Also, the cylindrical space preferably has a diameter large enough to prevent the hydraulic oil conduit 530 from coming into contact with the inner surface of the rotary joint housing 520 when the main shaft 200 performs a gyratory movement.

A rotary seal conduit 560 is formed in a pipe shape, and formed of a hard material subjected to heat treatment. The diameter of the upper portion of the rotary seal conduit 560 is smaller than the diameter of the lower portion of the rotary seal conduit 560. A plurality of separation-preventive annular protrusions 562 are formed on an outer circumferential surface of the rotary seal conduit 560. A tightening pipe 570 is coupled to the rotary seal conduit 560 and the hydraulic oil conduit 530 so that the tightening pipe 570 can tighten an outer circumferential surface of a lower end portion of the hydraulic oil conduit 530 in a state where the lower end portion of the hydraulic oil conduit 530 is fastened to the upper portion of the rotary seal conduit 560. Therefore, even if the pressure of the hydraulic oil is strong, the hydraulic oil conduit 530 can be reliably prevented from being separated from the rotary seal conduit 560. The rotary seal conduit 560 is fitted into the inner surface 524 of the cylindrical space. Even if the suspension bearing 220 is slightly worn out, and thus, the main shaft 200 descends, the rotary seal conduit 560 can maintain its original position without descending. Moreover, since the gap between the outer circumferential surface of the rotary seal conduit 560 and the inner circumferential surface of the rotary joint housing 520 is sealed by a seal 526, leakage of the hydraulic oil can be prevented.

The hydraulic oil conduit 530 is preferably formed of a material that can be smoothly bent and can strongly resist a force applied in the longitudinal direction. For example, a hose, which is reinforced with metal wire, such as steel, wound around its outer circumferential surface, and is formed of rubber, may be used as the hydraulic oil conduit 530.

A position shown by C in FIG. 3 corresponds to the center of a gyratory movement when the main shaft 200 performs a gyratory movement, and at that position, theoretically there is no movement. The lower end portion of the hydraulic oil conduit 530 can move minutely to follow the gyratory movement of the main shaft 200. However, since the upper end portion of the hydraulic oil conduit 530 is coupled to the conduit fixing part 540, the upper end portion of the hydraulic oil conduit 530 does not move.

The center C of the gyratory movement of the main shaft 200 is located on the central axis X of the main shaft 200, and simultaneously, if the hydraulic oil conduit 530 is provided such that the center C of the gyratory movement is located on the hydraulic oil conduit 530, there are advantages that the movement of the hydraulic oil conduit 530 is minimized, and thus, the lifespan of the hydraulic oil conduit 530 becomes longer, and the gyratory movement of the main shaft 200 becomes smooth.

The center of the gyratory movement of the main shaft 200 is located on the axis X of the main shaft 200, and simultaneously, if the hydraulic oil conduit 530 is disposed such that the center of the gyratory movement is located on the hydraulic oil conduit 530, there are advantages that the bending of the hydraulic oil conduit 530 is minimized, and thus, the lifespan of the hydraulic oil conduit 530 becomes longer, and the gyratory movement of the main shaft 200 becomes smooth.

The suspension bearing chamber seal 218 is formed in an annular shape, and formed of an elastic material, and has the inner-diameter portion that surrounds the outer circumferential surface of the main shaft 200 and the outer-diameter portion that is coupled to the lower end portion of the suspension bearing chamber 210 so that dust can be prevented from flowing into the space between the lower opening of the suspension bearing chamber 210 and the outer circumferential surface of the main shaft 200. The place where the main shaft 200 has the least movement when the main shaft 200 performs a gyratory movement is in the vicinity of the center of the gyratory movement. Therefore, the suspension bearing chamber seal 218 is preferably disposed such that the inner-diameter portion of the suspension bearing chamber seal 218 is located in the vicinity of the center of the gyratory movement of the main shaft 200 so that the amount of deformation of the suspension bearing chamber seal 218 caused by the gyratory movement of the main shaft 200 can be minimized.

Figure 4:
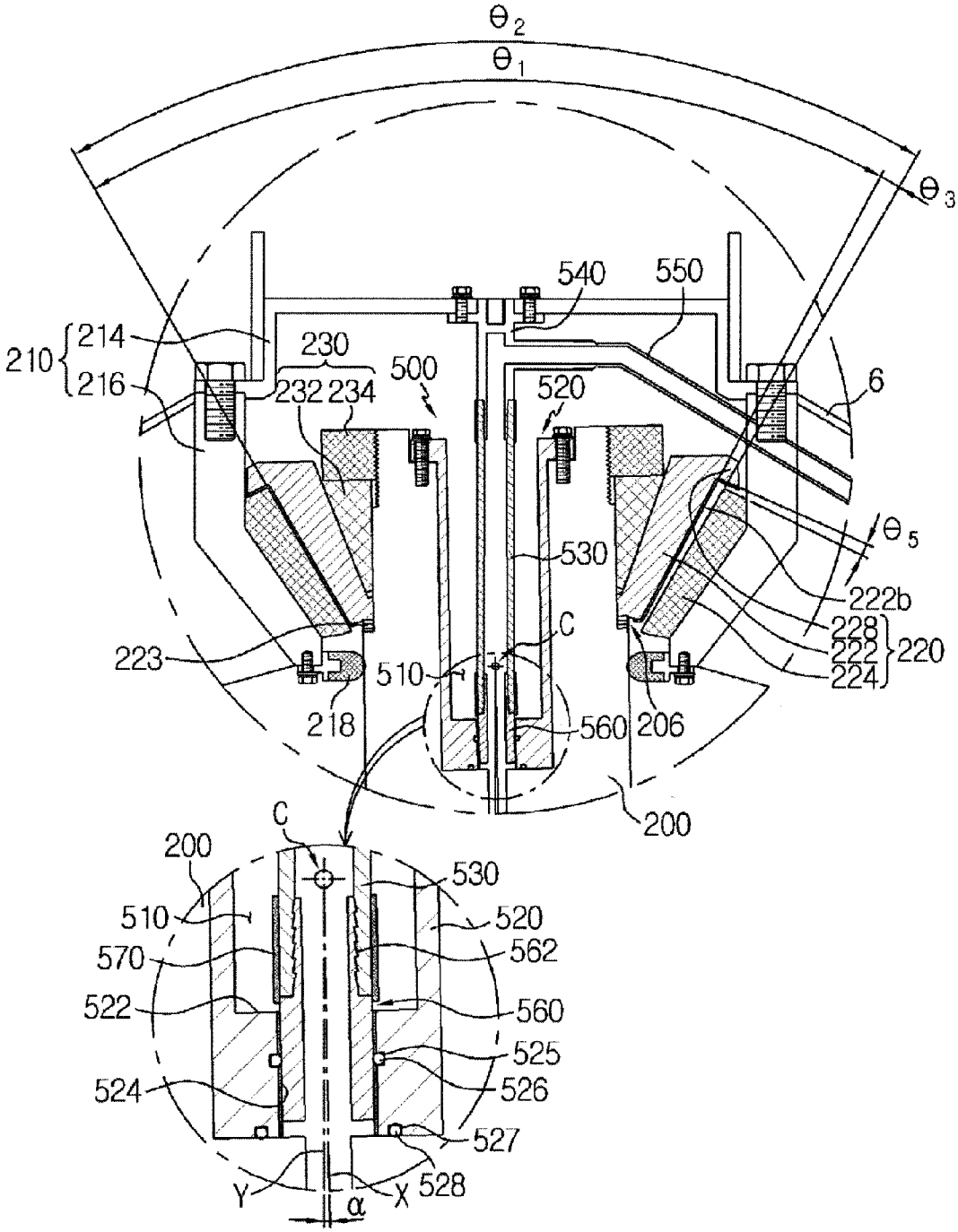

FIG. 4 is a partially enlarged view illustrating a cone-shaped crusher according to a third embodiment of the invention, and illustrating the upper end portion of the main shaft and the suspension bearing chamber.

Referring to FIG. 4, the difference between the third embodiment and the second embodiment is the structure of the suspension bearing 220. That is, the second embodiment includes the lower support protrusion 226, but the third embodiment includes an upper support protrusion 228 instead of the lower support protrusion 226.

The upper support protrusion 228 extends annularly from the upper end portion of the rotary ring 222 toward the inner circumferential surface of the suspension bearing chamber 210 and is supported by the upper end portion of the stationary ring 224. Also, a gap is preferably present between an outer circumferential surface of the upper support protrusion 228 and the inner circumferential surface of the suspension bearing chamber 210 so as to prevent wear from occurring while the main shaft 200 performs a gyratory movement.

If the main shaft 200 performs a gyratory movement, the outer circumferential surface of the rotatable ring 222 and a lower surface of the upper support protrusion 228 come into contact with the inner circumferential surface and upper surface of the stationary ring 224. Therefore, in order to prevent the rotatable ring 222 and the upper support protrusion 228, and the stationary ring 224 from being worn out, the outer circumferential surface of the rotatable ring 222 and the lower surface of the upper support protrusion 228 may be formed so as to be harder than the outer circumferential surface and upper surface of the stationary ring 224, or the outer circumferential surface and upper surface of the stationary ring 224 may be formed so as to be harder than the outer circumferential surface of the rotatable ring 222 and the lower surface of the upper support protrusion 228. For example, the surface of the stationary ring 224 may be formed of a hard material subjected to heat treatment, the outer circumferential surface of the rotatable ring 222 and the lower surface of the upper support protrusion 228 may be formed of a steel material, and a lubricious coating layer 222*b* may be formed on the surface of the steel material. On the contrary, the outer circumferential surface of the rotatable ring 222 and the lower surface of the upper support protrusion 228 may be formed of a hard material subjected to heat treatment, the stationary ring 224 may be formed of a steel material softer than the hard material, and a lubricious coating layer 222*b* may be formed on the surface of the steel material.

The lower surface of the upper support protrusion 228 and the upper surface of the stationary ring 224 are inclined such that the central portions of the lower and upper surfaces are located higher than their peripheries.

Also, a gap is formed between the upper surface of the stationary ring 224 and the lower surface of the upper support protrusion 228 at the place referred to the right portion of FIG. 4 opposite to the line referred to the left portion of FIG. 4 where the rotatable ring 222 and the stationary ring 224 come into contact with each other. Here, the gap becomes gradually larger in a direction away from the center of the main shaft 200. The angle $\theta_5$ between the upper surface of the stationary ring 224 and the lower surface of the upper support protrusion 228 at the point opposite to the contact point is two times greater than the eccentric angle $\alpha$ of the main shaft 200. Therefore, the main shaft 200 can smoothly perform a gyratory movement in a state where the outer circumferential surface of the rotatable ring 222 comes into contact with the inner circumferential surface of the stationary ring 224 or the lower surface of the upper support protrusion 228 comes into contact with the upper surface of the stationary ring 224.

When the cone-shaped crusher according to the invention does not crush objects to be crushed but idles, the weight of the main shaft 200 and the mantle core 320 in the second embodiment is supported by the upper surface of the lower support protrusion 226, and the weight of the main shaft 200 and the mantle core 320 in the third embodiment is supported by the upper surface of the stationary ring 224. In contrast, a relatively small load is applied to the inner circumferential surfaces of both of the stationary rings 224 in the second embodiment and the third embodiment.

On the other hand, a radial force or a longitudinal force generated by a crushing force is far greater than a longitudinal force generated by the weight of the main shaft 200 and the mantle core 320 while the objects to be crushed are crushed, and the outer circumferential surface of the rotatable ring 222 is supported by the inner circumferential surface of the stationary ring 224 in both of the second embodiment and the third embodiment. In contrast, a relatively small load is applied to the upper surface of the lower support protrusion 226 in the second embodiment, and a relatively small load is applied to the upper surface of the stationary ring 224 in the third embodiment.

As described above, the operation of the suspension bearing 220 has been described in the state where the operation state is divided into an idling state and a crushing state. In the idling state, the cone-shaped crusher idles, and in the crushing state, the cone-shaped crusher crushes the objects to be crushed. However, this operation difference is very little to such a degree that the difference cannot be sensed visually. That is, the difference is merely a difference such that an oil film coated on the suspension bearing 220 becomes thin or thick. Therefore, even if the idling state where the cone-shaped crusher idles is changed to the crushing state where the cone-shaped crusher crushes the objects to be crushed, or the crushing state is changed to the idling state, the cone-shaped crusher may be operated without concern for damage to the surface of the suspension bearing 220.

The angle $\theta_3$ between the stationary ring 224 and the rotary ring 222, and the eccentric angle $\alpha$ of the main shaft 200 are set so as to be optimized when the cone-shaped crusher crushes the objects to be crushed. Since the suspension bearings 220 in the second embodiment and the third embodiment include the lower support protrusion 226 or the upper support protrusion 228, a phenomenon is prevented in which the rotatable ring 222 minutely moves downward along the inner circumferential surface of the stationary ring 224 due to the weight of the main shaft 200 and the mantle core assembly 300 when the cone-shaped crusher idles.

Referring to FIGS. 3 and 4, a stepped part 206 limiting a depth, by which the rotatable ring 222 is fitted downward along the longitudinal direction of the main shaft 200, is formed at the upper end portion of the main shaft 200, and an annular rotatable-ring gap member 223 may be provided between the lower end portion of the rotatable ring 222 and the stepped part 206.

If the cone-shaped crusher is operated for a long time, and thereby, the outer circumferential surface of the rotatable ring 222 or the inner circumferential surface of the stationary ring 224 is worn out, the main shaft 200 can minutely descend. In this case, the height of the main shaft 200 can be again restored to its original height by releasing the fixing nut 234, pulling out at least one rotatable-ring gap member 223 by a thickness corresponding to a distance by which the main shaft 200 descends, and then fastening the fixing nut 234 again. In this way, the height of the main shaft relative to the suspension bearing chamber 210 can be adjusted by increasing or decreasing the number of rotatable-ring gap members 223.

Figure 5:
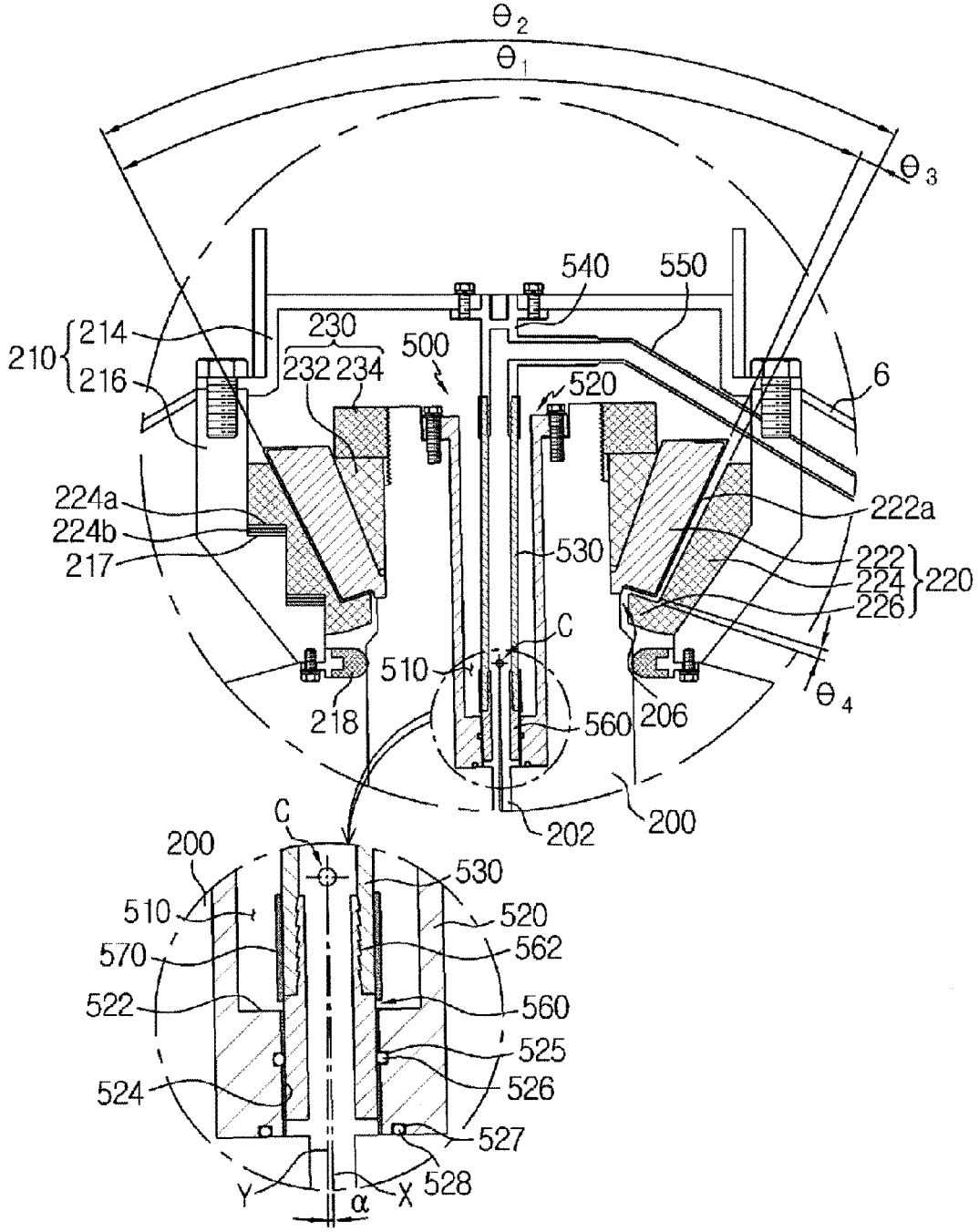
FIG. 5 is a partially enlarged view illustrating a cone-shaped crusher according to a fourth preferred embodiment of the invention, and illustrating the upper end portion of the main shaft and the suspension bearing chamber.

FIG. 5 is a partially enlarged view illustrating a cone-shaped crusher according to fourth embodiment of the invention, and illustrating the upper end portion of the main shaft and the suspension bearing chamber.

The fourth embodiment is a modification of the second embodiment. The second embodiment includes the rotatable-ring gap member 223, but the fourth embodiment includes a stationary-ring gap member 224*b*.

Referring to FIG. 5, the stationary ring 224 includes a stair-shaped stepped part 224*a* formed at its lower portion. The suspension bearing chamber 210 includes a stair-shaped stepped part 217 formed in the inner surface of the suspension bearing chamber 210, corresponding to the stepped part 224*a*. Also, an annular stationary-ring gap member 224*b* may be provided between the stepped part 224*a* and the stepped part 217.

When the outer circumferential surface of the rotatable ring 222 or the inner circumferential surface of the stationary ring 224 is worn out, and thus, the main shaft 200 descends, the height of the main shaft 200 can be again restored to its original height by releasing the fixing nut 234, further fitting the stationary-ring gap member 223 by a thickness corresponding to the distance by which the main shaft 200 descends, and then fastening the fixing nut 234. In this way, the height of the main shaft relative to the suspension bearing chamber 210 can be adjusted by increasing or decreasing the number of stationary-ring gap members 224*b*. In FIG. 5, the stepped part 224*a* and the stepped part 217 are formed in two stages, but it is apparent that the stepped part 224*a* and the stepped part 217 may be formed in a single stage or formed in three or more stages.

Moreover, it is possible to provide a modification in which both of the rotatable-ring gap member 223 and the stationary-ring gap member 224*b* are used so as to adjust the height of the main shaft relative to the suspension bearing chamber 210. That is, annular rotatable-ring gap members 223 may be provided between the lower end portion of the rotatable ring 222 and the stepped part 206, and simultaneously, annular stationary-ring gap members 224*b* may be provided between the stepped part 224*a* formed in the lower portion of the stationary ring 224, and the stepped part 217 formed in the inner surface of the suspension bearing chamber 210.

According to the cone-shaped crusher embodying the technical ideas of the second embodiment, the third embodiment, and the fourth embodiment, if pollutants, such as dust, are not mixed into lubricant, such as grease, in a state where the lubricating oil is sufficiently supplied to the suspension bearing 220, wear is hardly generated. Even if the suspension bearing 220 is worn out, the main shaft 200 can stably perform a gyratory movement in a state where the main shaft 200 is inclined by a predetermined eccentric angle $\alpha$ by pulling out a reasonable number of rotatable-ring gap members 223 or further fitting a reasonable number of stationary-ring gap members 224*b*.

As described above, if the height of the main shaft 200 is corrected by using the rotatable-ring gap member 223 or the stationary-ring gap member 224*b*, the lifespan of the suspension bearing 220 included in the cone-shaped crusher according to the invention can be semi-permanent.

Although the invention has been described by means of the limited embodiments and drawings, the invention is not limited by these, but those having ordinary knowledge in the art to which the invention belongs will apparently appreciate that various modifications and alternations are possible within the scope of the technical idea of the invention and the scope of the equivalents of the claims set forth below.

The invention claimed is:

1. A cone-shaped crusher comprising:

a frame having a cavity;

a main shaft disposed in the cavity eccentrically from a central axis of the frame;

main shaft driving means for driving the main shaft such that the main shaft performs a gyratory movement;

a mantle core assembly coupled to the main shaft so as to perform a gyratory movement together with the main shaft;

a suspension bearing chamber capable of accommodating an upper end portion of the main shaft; and a suspension bearing including a stationary ring and a rotatable ring, the stationary ring being provided on an inner circumferential surface of the suspension bearing chamber, and the rotatable ring being coupled to the upper end portion of the main shaft and being surrounded by an inner circumferential surface of the stationary ring, wherein an outer circumferential surface of the rotatable ring is formed in the shape of a rotary body having a rotation radius that gradually decreases downward from above, wherein the inner circumferential surface of the stationary ring is formed such that the inner diameter gradually decreases downward from above so as to correspond to the shape of the outer circumferential surface of the rotatable ring, wherein the angle $\theta_2$ between two cross sectional lines of inner circumferential surface of the stationary ring taken along the central axis of the stationary ring is greater than the angle $\theta_1$ between two cross sectional lines of outer circumferential surface of rotatable ring taken along the central axis of the rotatable ring, wherein the difference angle $\theta_3$ between $\theta_1$ and $\theta_2$ is greater than the eccentric angle $\alpha$ of the main shaft, and wherein the outer circumferential surface of the rotatable ring is pressed against and brought into contact with the inner circumferential surface of the stationary ring due to the weight of the main shaft and the mantle core assembly.

2. The cone-shaped crusher of claim 1, wherein the difference angle $\theta_3$ is two times greater than the eccentric angle $\alpha$ of the main shaft.

3. The cone-shaped crusher of claim 1, wherein the outer circumferential surface of the rotatable ring and the inner circumferential surface of the stationary ring are formed such that the reduction rate of the rotation radius is uniform or gradually increased or reduced downward from above.

4. The cone-shaped crusher of claim 1, further comprising a fixing member fixing the rotatable ring to the main shaft.

5. The cone-shaped crusher of claim 4, wherein an inner circumferential surface of the rotatable ring is formed in a shape that becomes gradually narrower downward from above, wherein the fixing member includes:

a detachable sleeve coupled to the main shaft, the rotation radius of outer circumferential surface of the detachable sleeve becoming gradually reduced downward from above so as to correspond to the inner circumferential surface of the rotatable ring; and a fixing nut coupled to an upper end of the main shaft exposed above the detachable sleeve such that the detachable sleeve is pressed downward and the outer circumferential surface of the detachable sleeve comes into contact with the inner circumferential surface of the rotatable ring.

6. The cone-shaped crusher of claim 1, wherein a suspension bearing seal member surrounding an upper outer circumferential surface of the main shaft is provided at a lower end portion of the suspension bearing chamber so as to prevent dust from flowing into a space between the suspension bearing chamber and the main shaft, wherein the center of the gyratory movement of the main shaft is located on a central axis of the main shaft, and wherein an inner-diameter portion of the suspension bearing seal member is provided in the vicinity of the center of the gyratory movement of the main shaft such that the amount of deformation of the suspension bearing seal member due to the gyratory movement of the main shaft is minimized.

7. The cone-shaped crusher of claim 1, wherein the stationary ring of the suspension bearing further includes a lower support protrusion capable of supporting the lower end portion of the rotatable ring, the lower support protrusion annularly extending from the lower end portion of the stationary ring toward an outer circumferential surface of the main shaft, wherein the gap formed between the lower surface of the rotatable ring and the upper surface of the lower support protrusion at a point opposite to the contact point between the rotatable ring and the stationary ring gradually increases away from the center of the main shaft, wherein the angle $\theta_4$ between the lower surface of the rotatable ring and the upper surface of the lower support protrusion at the point opposite to the contact point is two times greater than the eccentric angle $\alpha$ of the main shaft, and wherein the main shaft is capable of performing a gyratory movement in a state where the outer circumferential surface of the rotatable ring comes into contact with the inner circumferential surface of the stationary ring or the lower surface of the rotatable ring comes into contact with the upper surface of the lower support protrusion.

8. The cone-shaped crusher of claim 7, wherein the inner circumferential surface of the stationary ring and the upper surface of the lower support protrusion is formed so as to be harder than the outer circumferential surface and lower surface of the rotatable ring or the outer circumferential surface and lower surface of the rotatable ring is formed so as to be harder than the inner circumferential surface of the stationary ring and the upper surface of the lower support protrusion.

9. The cone-shaped crusher of claim 7, wherein the lower surface of the rotatable ring and the upper surface of the lower support protrusion are inclined such that the central portions of the upper and lower surfaces are located higher than their peripheries.

10. The cone-shaped crusher of claim 1, wherein the suspension bearing further includes an upper support protrusion capable of being supported by the upper end portion of the stationary ring, the upper support protrusion annularly extending from an upper end portion of the rotatable ring toward the inner circumferential surface of the suspension bearing chamber, wherein a gap formed between an upper surface of the stationary ring and a lower surface of the upper support protrusion at a point opposite to the contact point between the rotatable ring and the stationary ring gradually increases away from the center of the main shaft, wherein the angle $\theta_5$ between the upper surface of the stationary ring and the lower surface of the upper support protrusion at the point opposite to the contact point is two times greater than the eccentric angle $\alpha$ of the main shaft, and wherein the main shaft is capable of performing a gyratory movement in a state where the outer circumferential surface of the rotatable ring comes into contact with the inner circumferential surface of the stationary ring or the lower surface of the upper support protrusion comes into contact with the upper surface of the stationary ring.

11. The cone-shaped crusher of claim 10, wherein the inner circumferential surface and upper surface of the stationary ring are formed so as to be harder than the outer circumferential surface of the rotatable ring and the lower surface of the upper support protrusion or the outer circumferential surface of the rotatable ring and the lower surface of the upper support protrusion are formed so as to be harder than the inner circumferential surface and upper surface of the stationary ring.

12. The cone-shaped crusher of claim 10, wherein the upper surface of the stationary ring and the lower surface of the upper support protrusion are inclined such that the central portions of the upper and lower surfaces are located higher than their peripheries.

13. The cone-shaped crusher of claim 7, wherein a stepped part is provided at the upper end portion of the main shaft for limiting the depth of a portion of the rotatable ring that is fitted downward in the longitudinal direction of the main shaft, and wherein the height of the main shaft relative to the suspension bearing chamber is capable of being adjusted by changing the number of rotatable-ring gap members provided between the lower end portion of the rotatable ring and the stepped part.

14. The cone-shaped crusher of claim 7, wherein the stationary ring includes a stair-shaped first stepped part provided at its lower portion, wherein the suspension bearing chamber includes a stair-shaped second stepped part provided on its inner surface so as to correspond to the first stepped part, and wherein the height of the main shaft relative to the suspension bearing chamber is capable of being adjusted by changing the number of stationary-ring gap members provided between the first and second stepped parts.

15. The cone-shaped crusher of claim 10, wherein a stepped part is provided at the upper end portion of the main shaft for limiting the depth of a portion of the rotatable ring that is fitted downward in the longitudinal direction of the main shaft, and wherein the height of the main shaft relative to the suspension bearing chamber is capable of being adjusted by changing the number of rotatable-ring gap members provided between the lower end portion of the rotatable ring and the stepped part.

16. The cone-shaped crusher of claim 10, wherein the stationary ring includes a stair-shaped first stepped part provided at its lower portion, wherein the suspension bearing chamber includes a stair-shaped second stepped part provided on its inner surface so as to correspond to the first stepped part, and wherein the height of the main shaft relative to the suspension bearing chamber is capable of being adjusted by changing the number of stationary-ring gap members provided between the first and second stepped parts.

* * * * *